US006449889B1

(12) United States Patent
Hottenstein

(10) Patent No.: US 6,449,889 B1
(45) Date of Patent: Sep. 17, 2002

(54) VEHICLE LIGHTED DISPLAY DEVICE

(76) Inventor: Thomas G. Hottenstein, 15408 Kutztown Rd., Kutztown, PA (US) 19530

( * ) Notice: Subject to any disclaimer, the term of this patent is extended or adjusted under 35 U.S.C. 154(b) by 36 days.

(21) Appl. No.: 09/707,608

(22) Filed: Nov. 7, 2000

(51) Int. Cl.[7] ..... G09F 13/04

(52) U.S. Cl. ..... 40/575; 40/600; 40/591; 40/541; 362/205; 362/486; 340/473

(58) Field of Search ..... 40/611, 600, 597, 40/575, 541, 714, 715, 591; 362/205, 812, 486; 340/473, 471

(56) References Cited

U.S. PATENT DOCUMENTS

| | | | | | |
|---|---|---|---|---|---|
| 2,182,441 | A | * | 12/1939 | Lee | 40/575 |
| 2,675,983 | A | * | 4/1954 | King | 248/475.1 |
| 3,683,529 | A | | 8/1972 | Reed | |
| 3,826,026 | A | | 7/1974 | Bevan | |
| 4,445,291 | A | | 5/1984 | Easley | |
| 4,609,133 | A | * | 9/1986 | Anderson | 224/317 |
| 4,756,106 | A | | 7/1988 | Foster | |
| 4,903,423 | A | * | 2/1990 | Hinca | 40/205 |
| 5,005,306 | A | * | 4/1991 | Kinstler | 40/591 |
| 5,131,177 | A | | 7/1992 | Sy, Jr. | |
| 5,141,191 | A | | 8/1992 | Coffield | |
| 5,156,274 | A | * | 10/1992 | Williams, Jr. et al. | 206/573 |
| 5,386,960 | A | | 2/1995 | O'Brien | |
| 5,419,065 | A | * | 5/1995 | Lin | 40/550 |
| 5,622,389 | A | | 4/1997 | Courtney | |
| 5,636,462 | A | * | 6/1997 | Kleiman | 40/452 |
| 5,711,100 | A | * | 1/1998 | Elmer | 40/592 |
| 5,729,924 | A | * | 3/1998 | Reading | 40/564 |
| 5,758,441 | A | * | 6/1998 | Law | 40/492 |
| 5,771,619 | A | | 6/1998 | Wells | |
| 5,878,516 | A | | 3/1999 | Amirian | |

* cited by examiner

*Primary Examiner*—William L. Miller
(74) *Attorney, Agent, or Firm*—Dale J. Ream

(57) ABSTRACT

A lighted display device for use with a vehicle includes a pair of transparent spaced apart panes held by a frame member having opposed side walls and a bottom wall. The upper edges of the panes define an opening for the insertion or removal of a sign member having indicia indicative of the experience level or age of a driver or other message. The display device further includes a plurality of light assemblies having a light bulb in a front portion and a magnet in a rear portion for removably attaching the device to the metallic surface of a vehicle. A spring loaded button member protrudes from each rear portion and includes a battery that energizes a respective light bulb when the button member is depressed as the rear portion is magnetically coupled to a metallic surface.

21 Claims, 6 Drawing Sheets

VEHICLE LIGHTED DISPLAY DEVICE

BACKGROUND OF THE INVENTION

This invention relates generally to vehicle display devices and, more particularly, to a lighted display device that automatically energizes lights when the device is magnetically coupled to a metallic surface of a vehicle.

A young driver having limited driving experience or an older driver that operates a vehicle more slowly or with extra caution can be frustrating to other drivers who are unaware of the circumstance. Driver safety is enhanced when other drivers are alerted that the driver of another vehicle is one who may react more slowly to normal driving events.

Various display devices have been proposed in the art for attachment to vehicles for holding messages such as advertisements. Although assumably effective for their intended purposes, the existing devices are not easily removable from a vehicle without leaving evidence of the prior attachment or do not sufficiently draw the attention of other drivers to the signage.

Therefore, it is desirable to have a lighted display device for vehicles that is magnetically attachable to a vehicle and displays a removable and replaceable sign. Further, it is desirable to have a lighted display device having lights that are automatically actuated when the device is magnetically attached to a vehicle's metal surface.

SUMMARY OF THE INVENTION

A lighted display device for a vehicle according to the present invention includes a pair of spaced apart transparent panes that are held by a frame member having opposed side walls and a bottom wall extending therebetween. This configuration leaves an opening along upper edges of the panes through which a sign member may be inserted or removed. The sign member may include any desired indicia, such as "New Driver", "Old Driver", "For Sale", or advertising indicia. The invention is especially useful for displaying and drawing attention to the driver's driving experience level or advanced age.

A plurality of light assemblies are disposed on the side walls of the frame member. Each light assembly includes a front portion having a light bulb and light fixture. Each light assembly further includes a rear portion having a magnet, spring housing, and button member. Each button member normally extends rearwardly from a respective rear portion and is slidable within a corresponding spring housing. The display device is removably coupled to a metallic surface of a vehicle when the magnets are placed in contact with the metallic surface. Such an attachment causes each button member to move slidably into respective spring housings. Batteries mounted within each button member automatically energize respective light bulbs when the button members are sufficiently depressed into respective spring housings upon magnetic coupling of the display device to a vehicle.

Therefore, a general object of this invention is to provide a lighted display device which may be removably attached to a vehicle.

Another object of this invention is to provide a lighted display device, as aforesaid, having a plurality of magnets for removably attaching the device to a metallic surface of a vehicle.

Still another object of this invention is to provide a lighted display device, as aforesaid, which alerts other motorists relative to the level of driving experience of a driver.

Yet another object of this invention is to provide a lighted display device, as aforesaid, which automatically actuates a plurality of lights when the device is magnetically attached to a vehicle.

A further object of this invention is to provide a lighted display device, as aforesaid, which is durable and is economical to manufacture.

A still further object of this invention is to provide a lighted display device, as aforesaid, having a spring loaded button that is depressed by the vehicle metallic surface as the device is magnetically coupled thereto.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
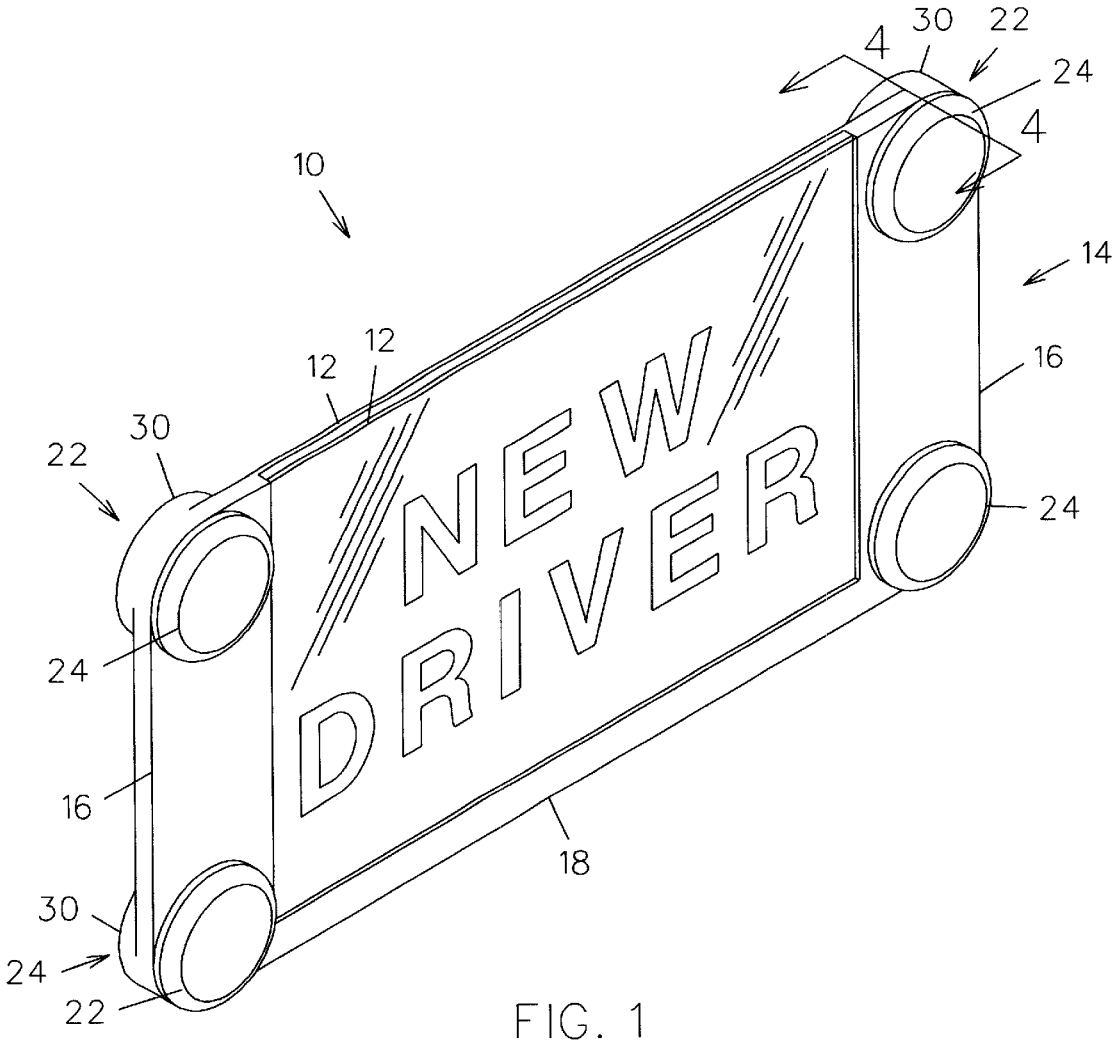
FIG. 1 is a perspective view of a lighted display device according to the present invention.
Figure 2:
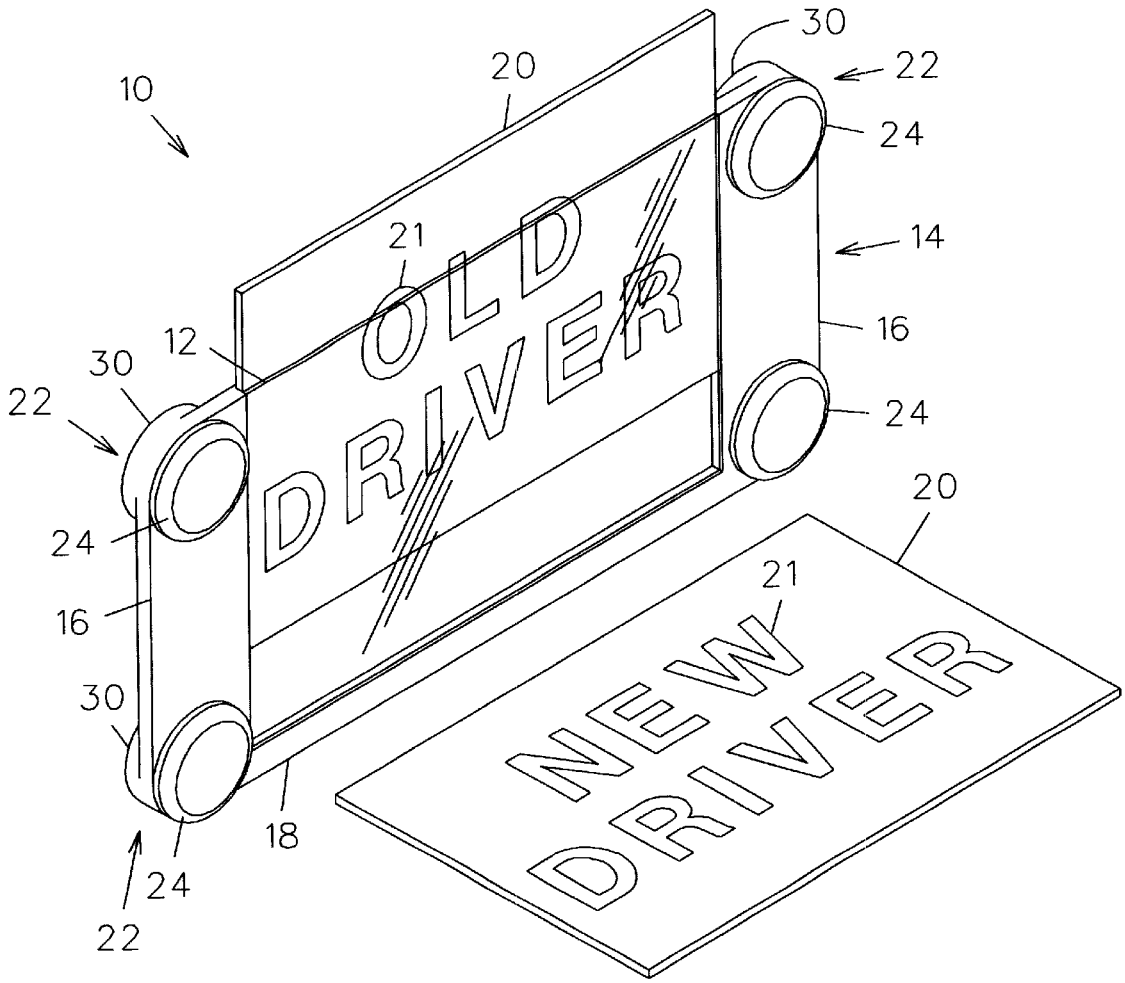
FIG. 2 is a perspective view of the display device as in FIG. 1 showing removal and replacement of sign members.

A lighted display device for use with a motor vehicle according to the present invention will now be described with reference to FIGS. 1–6 of the accompanying drawings. The display device 10 includes a pair of transparent panes 12 that are slightly spaced apart so as to define a space therebetween (FIG. 1). Preferably, the panes are constructed of a clear plastic material, although glass or Plexiglas® would also be suitable. The panes 12 are supported by a generally rectangular frame member 14 although the frame member could alternatively be round, triangular, or other shape. The frame member 14 includes opposed side walls 16 with an elongate bottom wall 18 extending therebetween. Therefore, side edges of the panes 12 are fixedly attached to corresponding side walls 16 and the bottom edges of the panes 12 are fixedly attached to and supported by the bottom wall 18. The top edges of the panes 12, therefore, remain free and define an opening into the space between the panes 12.

The display device 10 further includes a plurality of rectangular sign members 20, also referred to as indicia sheets. Each sign member 20 has dimensions complementary to the panes 12 and is configured to be slidably inserted or removed through the opening between the panes 12. Each sign member 20 includes indicia 21 indicative of the experience level of a driver (FIG. 2), that the vehicle is for sale (FIG. 5), or any other desired message or advertisement.

The display device 10 further includes a plurality of light assemblies 22 which operate both to draw attention to the device as well as to removably attach the device to a vehicle. Each light assembly 22 includes a cylindrical housing having a front portion 24 and a rear portion 30 (FIG. 1). The front 24 and rear 30 portions are integral to the side walls 16 of the frame member 14 and extend therethrough. In other words, the outer walls of the housing may be constructed integrally with the side walls 16 although each portion also includes independent interior elements, as to be described more fully below. Preferably, a light assembly 22 is disposed in each corner of the generally rectangular frame member 14.

Figure 3:
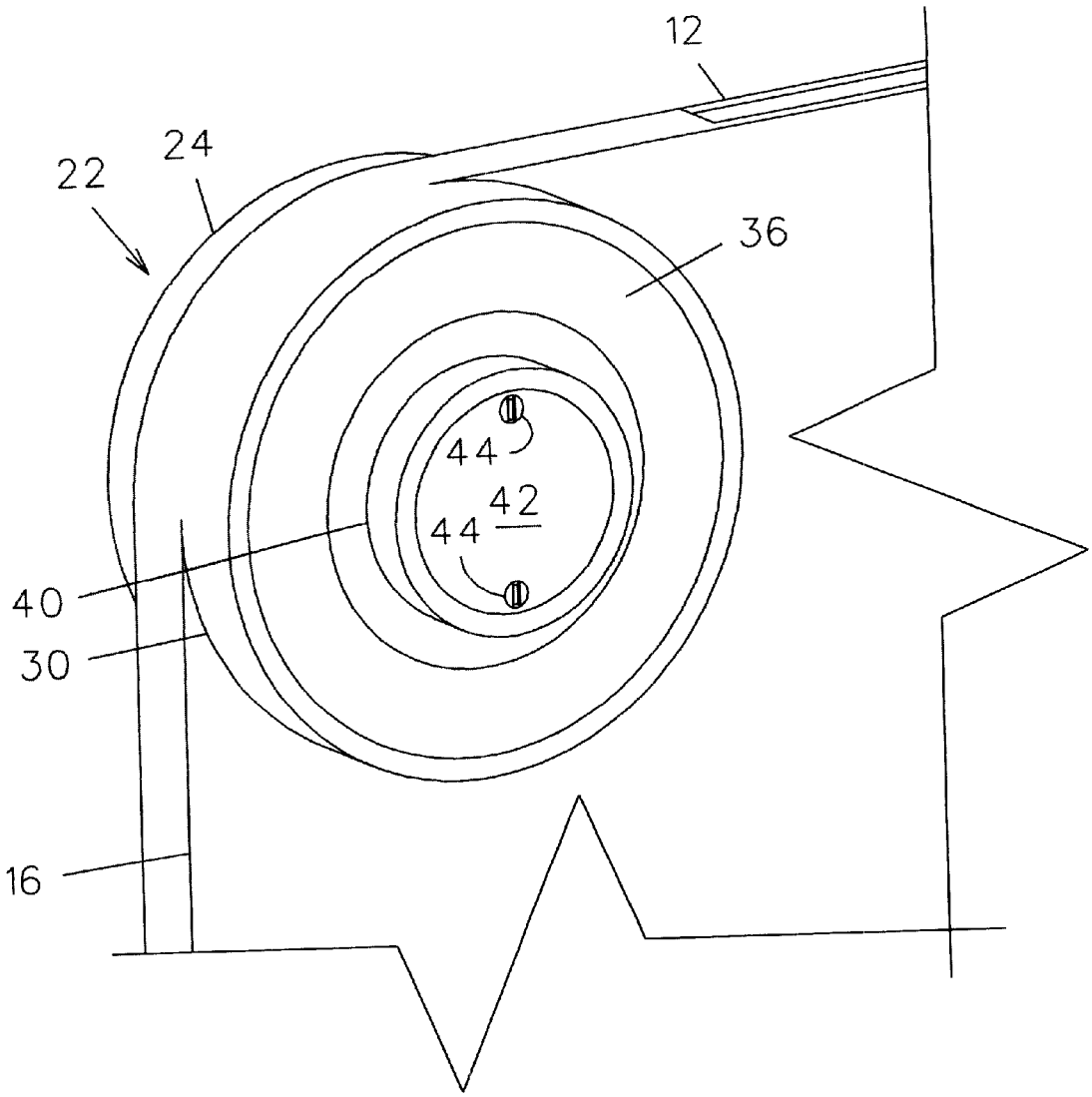
FIG. 3 is a fragmentary rear perspective view of the device as in FIG. 1 showing a light housing on an enlarged scale.
Figure 4:
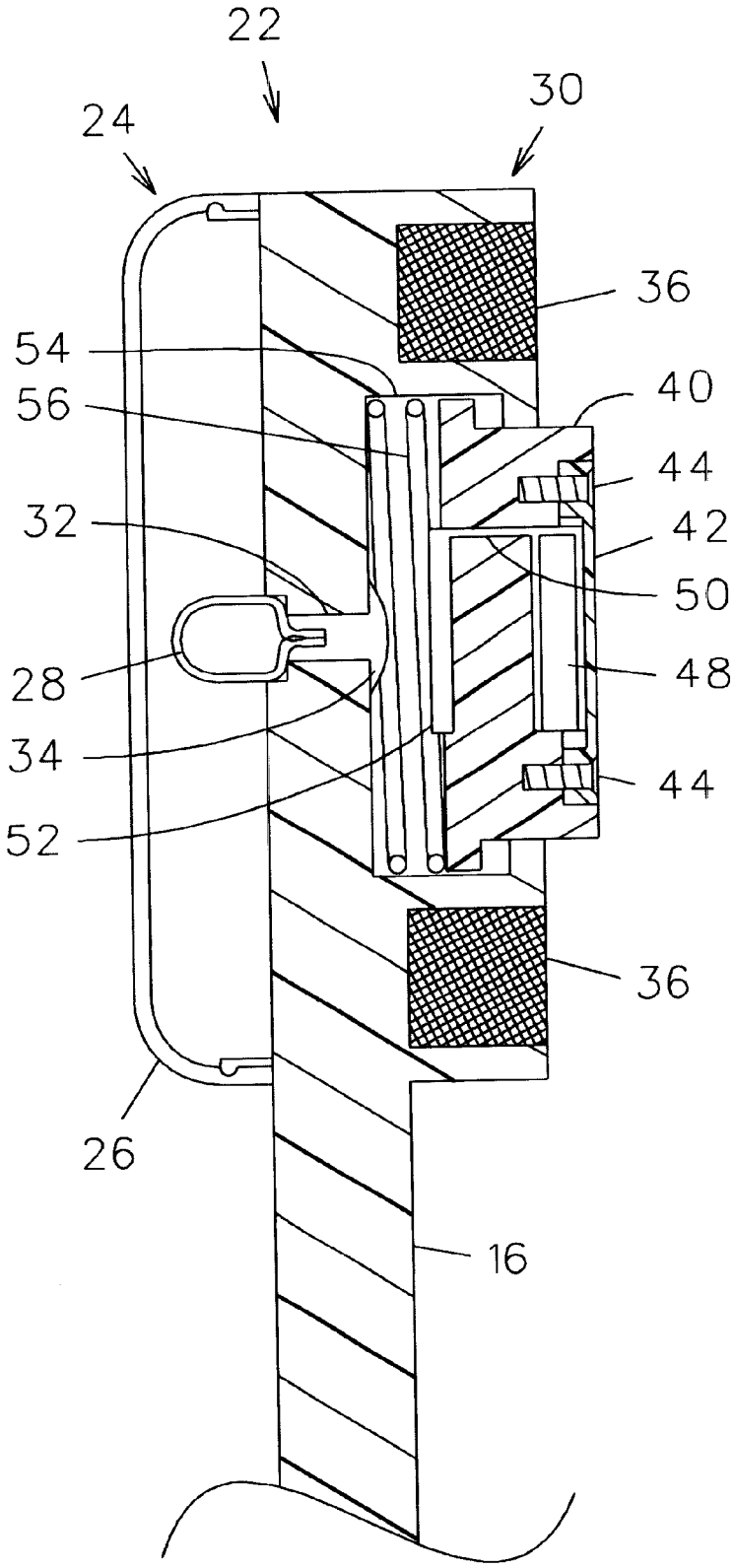
FIG. 4 is a sectional view of a light housing taken along line 4—4 of FIG. 1.
Figure 5:
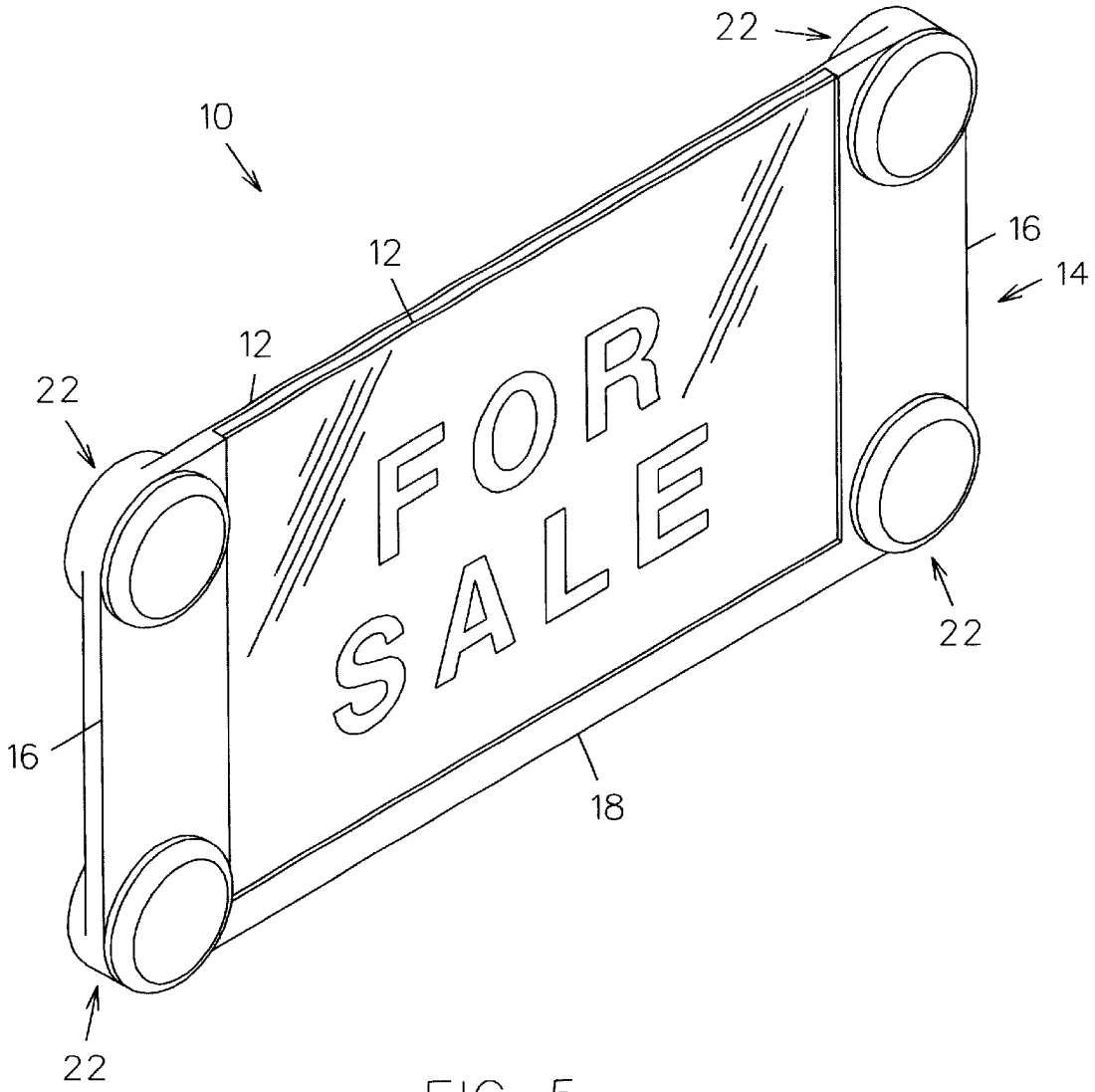
FIG. 5 is a perspective view of the display device as in FIG. 1 with another sign member displayed therein.

Each front portion 24 includes a translucent light fixture 26 that is snappably attached to a respective side wall 16. Each fixture may be clear or colored. A light bulb 28 is removably coupled to an electrical receptacle 32 within each front portion 24, the receptacle extending through the respective side wall 16 into the rear portion 30 (FIG. 4). A ring magnet 36 is disposed in the rear portion 30 of each light assembly 22 for coupling a respective rear portion 30 to a metallic surface of a vehicle when positioned thereon. A cylindrical button member 40 protrudes from a rear surface of the rear portion 30 and is concentric thereto (FIG. 3). Each button member 40 defines an inner chamber in which a battery 48 is mounted. An access panel 42 is removably attached to each button member 40 with screws 44 for providing user access to the battery 48 (FIGS. 3 and 4). Each button member 40 includes an L-shaped metal contact arm 50 that is electrically connected at one end to a corresponding battery 48, the other end 52 extending forwardly from the battery 48 in a direction toward a side wall 16 for selectable contact with the receptacle 32, as to be more fully described below.

A cylindrical spring housing 54 having a compression spring 56 mounted therein is disposed within the rear portion 30 of each light assembly 22. A rearward end of each spring housing 54 is open for receiving a corresponding button member 40 therein in a slide-fit relationship (FIG. 4). Each spring housing 54 has a diameter slightly larger than a diameter of a corresponding button member 40. Each compression spring 56 includes a normally unbiased configuration which holds a corresponding button member 40 in a configuration protruding from the rear surface of a rear portion 30. However, a button member 40 may be depressed for slidable movement into a corresponding spring housing 54, such inward movement compressing the spring 56 therein. When fully depressed, the other end 52 of a respective contact arm 50 extends through the inner space defined by the coils of the spring 56 so as to contact the rearward end 34 of the receptacle 32. Thus, the light bulb 28 is energized when the button member 40 is depressed into a corresponding spring housing 54.

It should be appreciated that a diameter of each ring magnet 36 is greater than a diameter of each spring housing 54. The ring magnets 36 are of sufficient size and strength to magnetically hold the rear portions 30 of the light assemblies 22 to a metallic surface of a vehicle even though the compression springs 56 push outwardly against the button members 40 which are depressed by contact with the metallic surface.

In use, batteries 48 and light bulbs 28 may be initially inserted or replaced in each light assembly 22 by removing the light fixtures 26 and access panels 42 respectively. A sign member 20 having desired indicia thereon may be inserted through the opening into the space between the display panes 12. As the frame member 14 is positioned upon a metallic surface of a vehicle, the button members 40 are depressed by contact with the metallic surface as the magnets 36 are magnetically coupled thereto. Depression of the button members 40 causes the springs 56 to compress and allows the contact arms 50 to become electrically connected with corresponding receptacle ends 34. Thus, the light bulbs 28 are energized. When the frame member 14 is removed from the metallic surface of the vehicle, the springs return to their normally unbiased configuration which moves the button members 40 outwardly and deactivates the lights.

Figure 6:
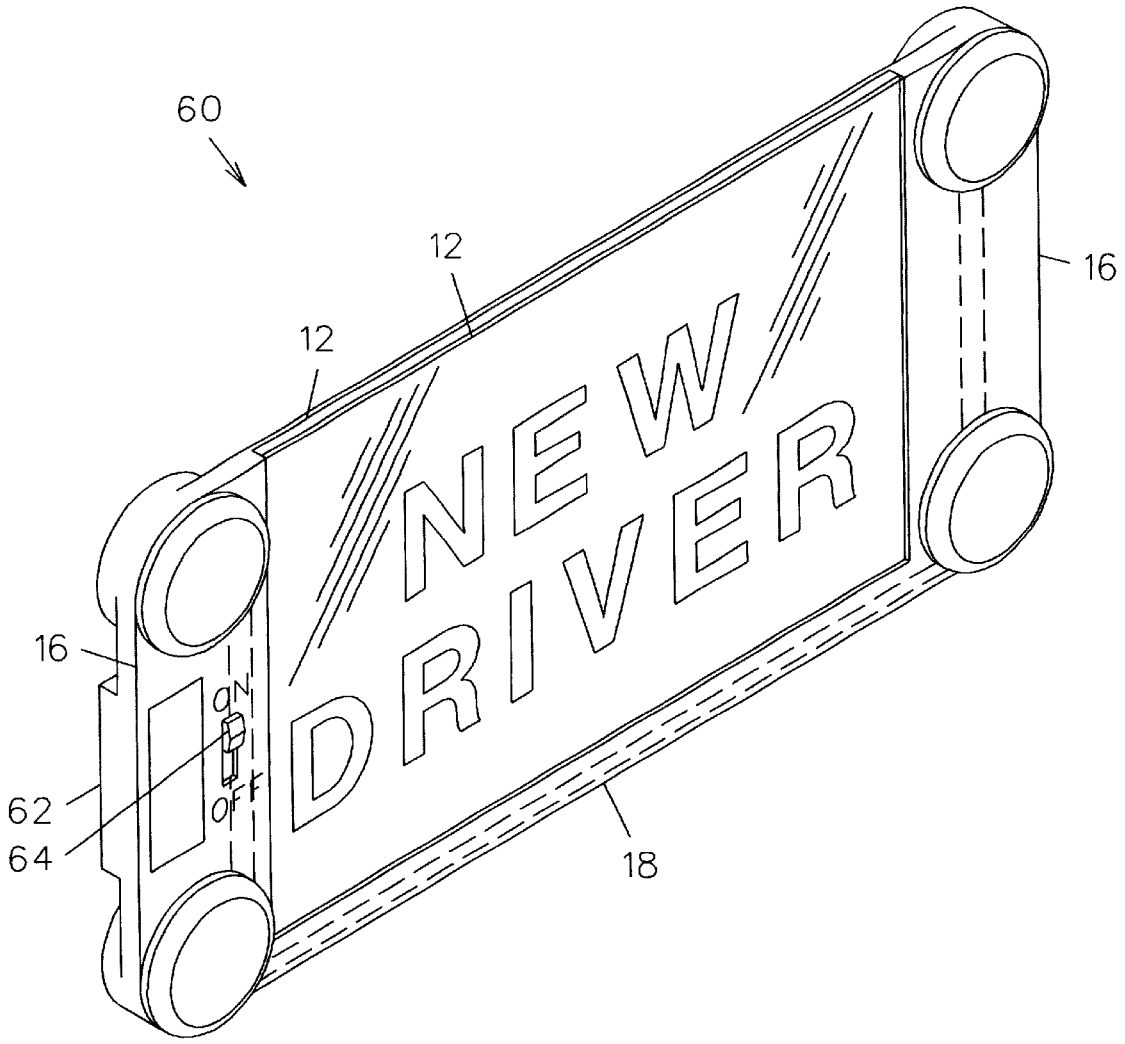
FIG. 6 is a perspective view of a lighted display device according to another embodiment of the present invention.

Another embodiment of the lighted display device 60 is shown in FIG. 6 and is very similar to the embodiment described above except as specifically noted below. A battery housing 62 is fixedly attached to one side wall 16 of the frame member 14 and having a single battery therein. This battery is electrically connected to the contact member within each light assembly with wires. An on/off switch 64 allows a user to regulate when those contact members are energized. Then, attachment of the device to a vehicle and, thus, depression of the button members 40 will result in the light bulbs 28 being energized only when the contact members 50 are selectively energized.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A lighted display device for a vehicle, comprising:

a pair of spaced apart panes defining an opening along upper edges thereof;

a frame member about said panes having opposed side walls and a bottom wall extending longitudinally between said side walls for holding said panes;

an indicia sheet positioned between said panes and adapted to be inserted or removed through said opening;

a plurality of light assemblies spaced apart along said side walls, each light assembly comprising:

a cylindrical housing integrally extending through a respective said side wall of said frame member and having a front portion and a rear portion;

a light bulb disposed in said front portion;

a magnet disposed in said rear portion for removably coupling said frame member to a metallic surface;

a battery disposed in said rear portion; and means in said rear portion for moving said battery between a first position displaced from said light bulb when said frame member is not magnetically coupled to said metallic surface and a second position electrically connected to said light bulb when said frame member is magnetically coupled to said metallic surface, whereby said light bulb is energized when said frame member is magnetically coupled to said metallic surface.

2. The lighted display device as in claim 1 wherein said moving means comprises:

a spring housing having a compression spring positioned therein, said spring housing having a receptacle electrically connected to said light bulb;

a button member coupled to said spring housing and adapted for slidable engagement therewith, said battery being disposed in said button member and having means for electrical connection with said receptacle upon selective inward movement of said button member into said spring housing.

3. The lighted display device as in claim 2 wherein said connecting means includes a metal arm connected to said battery and extending through coils of said spring for contact with said receptacle upon selective inward movement of said button member into said spring housing, said spring causing said button member to protrude from a rear surface of said rear portion in an unbiased configuration when said frame member is not magnetically coupled to said metallic surface and said spring being compressed by said button member in a biased configuration when said frame member is magnetically coupled to said metallic surface.

4. The lighted display device as in claim 2 wherein said button member and said spring housing have cylindrical configurations, a diameter of said button member being less than a diameter of said spring housing.

5. The lighted display device as in claim 2 wherein said magnet includes a circular configuration having a diameter greater than a diameter of said spring housing, said spring housing being concentric to said magnet.

6. The lighted display device as in claim 1 wherein said frame member includes a rectangular configuration, said plurality of light assemblies being disposed in corners thereof.

7. The lighted display device as in claim 1 wherein said indicia sheet includes indicia indicative of a new driver.

8. The lighted display device as in claim 1 wherein said indicia sheet includes indicia indicative of an experienced driver.

9. The lighted display device as in claim 1 wherein said indicia sheet includes indicia indicative that the vehicle is for sale.

10. A lighted display device for use with a vehicle, comprising:

a frame member having opposed side walls and a bottom wall extending between said side walls;

a removable sign member adapted to be supported by said bottom wall and held between said opposed side walls of said frame member;

at least one light assembly comprising:

a front portion positioned on a front surface of a respective said side wall of said frame member;

a rear portion positioned on a rear surface of said respective side wall of said frame member complementary to said front portion;

a light bulb disposed in said front portion;

a battery disposed in said rear portion; and a magnet disposed in said rear portion for removably coupling said frame member to a metallic surface; and means for delivering current from said battery to said light bulb upon magnetic coupling of said frame member to said metallic surface, said magnetic coupling causing said battery to be moved from a first position displaced from said light bulb to a second position electrically connected to said light bulb.

11. The lighted display device as in claim 10 further comprising a pair of rectangular transparent panes having opposed side edges fixedly attached to corresponding said side walls and having bottom edges fixedly attached to said bottom wall, said panes being spaced apart and having free upper edges between which said sign member may be removed and replaced.

12. The lighted display device as in claim 10 wherein said current delivering means comprises:

a spring housing disposed in said rear portion having a compression spring disposed therein;

a receptacle electrically connected with said light bulb and positioned for communication with said spring housing;

a button member coupled to said spring housing for slidable engagement therewith, said button adapted to compress said spring when said rear portion of said light assembly is magnetically coupled to said metallic surface and to extend outwardly from a rear surface of said rear portion when said light assembly is not magnetically coupled to said metallic surface, said battery being positioned in said button member and having means for energizing said light bulb upon a compression of said spring.

13. The lighted display device as in claim 12 wherein said means for delivering current includes a metal arm connected to said battery and extending through said spring for contact with said receptacle upon a slidable movement of said button member into said spring housing.

14. The lighted display device as in claim 12 wherein said button member includes a door at a free end thereof for user access to said battery therein.

15. The lighted display device as in claim 12 wherein said front and rear portions, spring housing, and button member have cylindrical configurations.

16. The lighted display device as in claim 15 wherein said magnet includes a circular configuration having a diameter greater than a diameter of said spring housing.

17. The lighted display device as in claim 10 wherein said sign member includes indicia indicative of a new driver.

18. The lighted display device as in claim 10 wherein said sign member includes indicia indicative of an experienced driver.

19. The lighted display device as in claim 10 wherein said sign member includes indicia indicative that the vehicle is for sale.

20. A lighted display device for a vehicle, comprising:

a pair of spaced apart panes defining an opening along upper edges thereof;

a frame member about said panes having opposed side walls and a bottom wall extending longitudinally between said side walls for holding said panes;

an indicia sheet positioned between said panes and adapted to be inserted or removed through said opening;

a battery coupled to said frame member;

a plurality of light assemblies spaced apart along said side walls, each light assembly comprising:

a cylindrical housing integrally extending through a respective said side wall of said frame member and having a front portion and a rear portion;

a light bulb disposed in said front portion;

a magnet disposed in said rear portion for removably coupling said frame member to a metallic surface;

a contact member mounted in said rear portion and electrically connected to said battery, said contact member being selectively energized by said battery; and means in said rear portion for moving said contact member between a first position displaced from said light bulb when said frame member is not magnetically coupled to said matallic surface and a second position electrically connected to said light bulb when said frame member is magnetically coupled to said metallic surface, whereby said light bulb is energized when said frame member is magnetically coupled to said metallic surface and said contact member is energized by said battery.

21. The light assembly as in claim 20 wherein said moving means comprises:

a spring housing having a compression spring positioned therein, said spring housing having a receptacle electrically connected to said light bulb; and a button member coupled to said spring housing and adapted for slidable engagement therewith, said contact member being disposed in said button member for electrical connection with said receptacle upon selective inward movement of said button member into said spring housing.

* * * * *